US008615380B2

(12) United States Patent
Kim et al.

(10) Patent No.: US 8,615,380 B2
(45) Date of Patent: Dec. 24, 2013

(54) SYSTEM AND METHOD FOR DIAGNOSING HOME APPLIANCE

(75) Inventors: Hyun Sang Kim, Changwon-si (KR); Eui Hyeok Kwon, Changwon-si (KR); Hae Yong Kang, Changwon-si (KR); Yong Tae Kim, Changwon-si (KR); Koon Seok Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 547 days.

(21) Appl. No.: 12/757,232

(22) Filed: Apr. 9, 2010

(65) Prior Publication Data

US 2010/0262865 A1 Oct. 14, 2010

Related U.S. Application Data

(60) Provisional application No. 61/168,366, filed on Apr. 10, 2009.

(30) Foreign Application Priority Data

Apr. 10, 2009 (KR) ..... 10-2009-0031501

(51) Int. Cl.
*G06F 11/00* (2006.01)

(52) U.S. Cl.
USPC ..... 702/185

(58) Field of Classification Search
USPC ..... 702/183–185
See application file for complete search history.

(56) References Cited

U.S. PATENT DOCUMENTS

| | | | |
|---|---|---|---|
| 3,910,322 | A | 10/1975 | Hardesty et al. |
| 4,146,754 | A | 3/1979 | Rose |
| 4,766,505 | A | 8/1988 | Nakano et al. |
| 4,897,659 | A | 1/1990 | Mellon |
| 4,977,394 | A | 12/1990 | Manson et al. |
| 5,103,214 | A | 4/1992 | Curran et al. |
| 5,210,784 | A | 5/1993 | Wang et al. |
| 5,268,666 | A | 12/1993 | Michel et al. |
| 5,452,344 | A | 9/1995 | Larson |
| 5,506,892 | A | 4/1996 | Kojima et al. |
| 5,664,218 | A | 9/1997 | Kim et al. |

(Continued)

FOREIGN PATENT DOCUMENTS

| | | |
|---|---|---|
| CN | 1212304 | 3/1999 |
| CN | 1393672 | 1/2003 |

(Continued)

OTHER PUBLICATIONS

International Search Report dated Apr. 25, 2011 issued in Application No. PCT/KR 2010/004407.

(Continued)

*Primary Examiner* — Mohamed Charioui
(74) *Attorney, Agent, or Firm* — KED & Associates LLP

(57) ABSTRACT

A system and method for diagnosing a home appliance are disclosed. The home appliance outputs product information as a predetermined sound signal, and transmits the sound signal to a service center of a remote site over a communication network, such that a service technician of the service center can easily check a current status of the home appliance. The diagnostic system effectively detects data using multiple synchronous signals having a time difference, quickly diagnoses a current status or fault of the home appliance, provides a service for more correctly diagnosing a faulty operation of the home appliance, and increases user satisfaction and reliability.

14 Claims, 7 Drawing Sheets

(56) References Cited

U.S. PATENT DOCUMENTS

| | | | | |
|---|---|---|---|---|
| 5,757,643 | A | 5/1998 | Kuroda et al. | |
| 5,774,529 | A | 6/1998 | Johannsen et al. | |
| 5,864,828 | A | 1/1999 | Atkins | |
| 5,939,992 | A | 8/1999 | Devries et al. | |
| 5,940,915 | A | 8/1999 | Nam | 8/159 |
| 5,987,105 | A * | 11/1999 | Jenkins et al. | 379/106.01 |
| 6,121,593 | A | 9/2000 | Mansbery et al. | |
| 6,759,954 | B1 | 7/2004 | Myron et al. | |
| 6,763,458 | B1 | 7/2004 | Watanabe et al. | 713/100 |
| 6,778,868 | B2 | 8/2004 | Imamura et al. | |
| 6,870,480 | B2 | 3/2005 | Suzuki et al. | |
| 6,906,617 | B1 | 6/2005 | Van der Meulen | |
| 7,135,982 | B2 | 11/2006 | Lee | 340/635 |
| 7,243,174 | B2 | 7/2007 | Sheahan et al. | |
| 7,266,164 | B2 | 9/2007 | Jeon et al. | |
| 7,280,643 | B2 | 10/2007 | Howard et al. | 379/93.37 |
| 7,337,457 | B2 | 2/2008 | Pack et al. | 725/40 |
| 7,363,031 | B1 | 4/2008 | Aisa | |
| 7,439,439 | B2 | 10/2008 | Hayes et al. | 84/600 |
| 7,509,824 | B2 | 3/2009 | Park et al. | 68/12.23 |
| 7,631,063 | B1 | 12/2009 | Ho et al. | |
| 7,648,476 | B2 | 1/2010 | Bock et al. | |
| 7,653,512 | B2 | 1/2010 | Cheung et al. | 702/184 |
| 7,750,227 | B2 | 7/2010 | Hayes et al. | |
| 7,843,819 | B1 | 11/2010 | Benveniste | |
| 7,965,632 | B2 | 6/2011 | Sugaya | |
| 8,027,752 | B2 | 9/2011 | Castaldo et al. | |
| 8,040,234 | B2 | 10/2011 | Ebrom et al. | 340/531 |
| 8,045,636 | B1 | 10/2011 | Lee et al. | |
| 8,132,049 | B2 | 3/2012 | Yasukawa et al. | |
| 8,204,189 | B2 | 6/2012 | Rhodes et al. | |
| 8,325,054 | B2 | 12/2012 | Kim et al. | |
| 8,391,255 | B2 | 3/2013 | Ribiere et al. | |
| 8,428,910 | B2 | 4/2013 | Papadimitriou et al. | |
| 2002/0029575 | A1 | 3/2002 | Okamoto | |
| 2002/0032491 | A1 | 3/2002 | Imamura et al. | |
| 2002/0078742 | A1 | 6/2002 | Kim | 73/162 |
| 2002/0097161 | A1 | 7/2002 | Deeds | |
| 2002/0116959 | A1 | 8/2002 | Ohta et al. | |
| 2002/0120728 | A1 | 8/2002 | Braatz et al. | |
| 2003/0028345 | A1 | 2/2003 | Watkins et al. | |
| 2003/0110363 | A1 | 6/2003 | Bachot et al. | |
| 2003/0128850 | A1 | 7/2003 | Kimura et al. | |
| 2003/0167782 | A1 | 9/2003 | Roh et al. | |
| 2003/0196492 | A1 | 10/2003 | Remboski et al. | 73/593 |
| 2004/0032853 | A1 | 2/2004 | D'Amico et al. | |
| 2004/0132444 | A1 | 7/2004 | Herrmann | |
| 2004/0158333 | A1 | 8/2004 | Ha et al. | |
| 2004/0211228 | A1 | 10/2004 | Nishio et al. | |
| 2004/0249903 | A1 | 12/2004 | Ha et al. | |
| 2004/0261468 | A1 | 12/2004 | Lueckenbach | |
| 2005/0015890 | A1 | 1/2005 | Kim et al. | |
| 2005/0029976 | A1 | 2/2005 | Terry et al. | |
| 2005/0086979 | A1 | 4/2005 | Son et al. | |
| 2005/0129200 | A1 | 6/2005 | Forrest et al. | 379/93.37 |
| 2005/0134472 | A1 | 6/2005 | Jang et al. | |
| 2005/0162909 | A1 | 7/2005 | Wooldridge | |
| 2006/0048405 | A1 | 3/2006 | Baek et al. | |
| 2006/0066758 | A1 | 3/2006 | Higashihara | |
| 2006/0089818 | A1 | 4/2006 | Norell et al. | |
| 2006/0136544 | A1 | 6/2006 | Atsmon et al. | |
| 2006/0168740 | A1 | 8/2006 | Ha et al. | |
| 2006/0259199 | A1 | 11/2006 | Gjerde et al. | |
| 2007/0113595 | A1 | 5/2007 | Harwood et al. | |
| 2007/0137265 | A1 | 6/2007 | Shikamori et al. | |
| 2007/0175883 | A1 | 8/2007 | Miu et al. | |
| 2007/0189323 | A1 | 8/2007 | Swoboda et al. | |
| 2007/0219756 | A1 | 9/2007 | Frankel et al. | |
| 2007/0272286 | A1 | 11/2007 | Curtius et al. | |
| 2008/0036619 | A1 * | 2/2008 | Rhodes et al. | 340/825 |
| 2008/0072383 | A1 | 3/2008 | Bextermoller et al. | |
| 2008/0122648 | A1 | 5/2008 | Ebrom et al. | |
| 2009/0067102 | A1 | 3/2009 | Cline et al. | |
| 2009/0160637 | A1 | 6/2009 | Maeng | |
| 2009/0169434 | A1 | 7/2009 | Ogusu | |
| 2009/0282308 | A1 | 11/2009 | Gutsche et al. | |
| 2009/0323914 | A1 | 12/2009 | Lee et al. | |
| 2010/0037401 | A1 | 2/2010 | Bae et al. | |
| 2010/0116060 | A1 | 5/2010 | Murayama | 73/593 |
| 2011/0022358 | A1 | 1/2011 | Han et al. | |
| 2011/0060553 | A1 | 3/2011 | Han et al. | |
| 2011/0200189 | A1 | 8/2011 | True et al. | |

FOREIGN PATENT DOCUMENTS

| | | | |
|---|---|---|---|
| CN | 1497915 | | 5/2004 |
| CN | 1606282 | | 4/2005 |
| CN | 101202639 | | 6/2008 |
| EP | 0 038 687 | | 10/1981 |
| EP | 0 510 519 | A1 | 10/1992 |
| EP | 0 617 557 | A2 | 9/1994 |
| EP | 0 691 060 | B1 | 1/1996 |
| EP | 0 742 308 | | 11/1996 |
| EP | 0 846 991 | | 6/1998 |
| EP | 0 851 054 | | 7/1998 |
| JP | 4-358497 | A | 12/1992 |
| JP | 10-133767 | | 5/1998 |
| JP | 11-127254 | | 11/1999 |
| JP | 2001-345949 | | 12/2001 |
| JP | 2001-353395 | A | 12/2001 |
| JP | 2002-000988 | A | 1/2002 |
| JP | 2002-011274 | A | 1/2002 |
| JP | 2002-045590 | A | 2/2002 |
| JP | 2002-85887 | | 3/2002 |
| JP | 2002-162149 | | 6/2002 |
| JP | 2002-279091 | | 9/2002 |
| JP | 2007-267956 | A | 10/2007 |
| JP | 2008-003562 | A | 1/2008 |
| KR | 10-1991-0020404 | A | 12/1991 |
| KR | 10-1996-003308 | A | 1/1996 |
| KR | 10-1996-0003308 | A | 1/1996 |
| KR | 10-1997-0019443 | A | 4/1997 |
| KR | 10-0127232 | B1 | 10/1997 |
| KR | 10-0143209 | | 8/1998 |
| KR | 20-1999-0040564 | U | 12/1999 |
| KR | 20-0162050 | | 12/1999 |
| KR | 10-2000-0018678 | A | 4/2000 |
| KR | 10-2001-0063913 | A | 5/2001 |
| KR | 10-2001-0055394 | A | 7/2001 |
| KR | 10-2002-0020831 | A | 3/2002 |
| KR | 10-2002-0030426 | A | 4/2002 |
| KR | 10-2002-0039959 | | 5/2002 |
| KR | 10-0389690 | B1 | 6/2003 |
| KR | 10-0406094 | B1 | 11/2003 |
| KR | 10-2004-0050767 | | 6/2004 |
| KR | 10-2004-0095017 | | 11/2004 |
| KR | 10-2004-0103352 | | 12/2004 |
| KR | 10-2005-0062747 | A | 6/2005 |
| KR | 10-2005-0097282 | A | 10/2005 |
| KR | 10-0564761 | B1 | 3/2006 |
| KR | 10-2006-0103014 | | 9/2006 |
| KR | 10-0641974 | | 11/2006 |
| KR | 10-2007-0013090 | A | 1/2007 |
| KR | 10-2008-0068447 | | 7/2008 |
| KR | 10-0887575 | | 3/2009 |
| KR | 10-2010-0112950 | | 10/2010 |
| KR | 10-2011-0010378 | | 2/2011 |
| WO | WO 01/11575 | | 2/2001 |
| WO | WO 2005/106096 | | 11/2005 |
| WO | WO 2008/010670 | | 1/2008 |

OTHER PUBLICATIONS

United States Office Action dated Dec. 27, 2011 issued in U.S. Appl. No. 12/432,184.

United States Office Action dated Feb. 10, 2012 issued in U.S. Appl. No. 12/568,022.

United States Office Action dated Feb. 14, 2012 issued in U.S. Appl. No. 12/431,910.

United States Office Action dated Mar. 1, 2012 issued in U.S. Appl. No. 12/846,040.

PCT International Search Report dated May 26, 2011 issued in Application No. PCT/KR2010/005108.

(56) References Cited

OTHER PUBLICATIONS

U.S. Office Action issued in U.S. Appl. No. 12/432,111 dated May 2, 2012.
European Search Report dated May 8, 2012.
Milica Stojanovic, "Recent Advances in High-Speed underwater Acoustic Communications"; IEEE Journal of Oceanice Engineering, IEEE Service Center; Piscataway, NJ; vol. 21, No. 2; Apr. 1, 1996; pp. 125-136 (XP011042321).
U.S. Office Action issued in U.S. Appl. No. 12/757,246 dated May 18, 2012.
U.S. Office Action issued in U.S. Appl. No. 12/757,339 dated May 22, 2012.
U.S. Notice of Allowance issued in U.S. Appl. No. 12/568,022 dated Jun. 11, 2012.
U.S. Office Action issued in U.S. Appl. No. 12/757,213 dated Jun. 25, 2012.
U.S. Office Action issued in U.S. Appl. No. 12/603,810 dated Jul. 5, 2012.
U.S. Office Action issued in U.S. Appl. No. 12/431,910 dated Jul. 23, 2012.
International Search Report dated Dec. 1, 2010 (PCT/KR2010/002211).
International Search Report dated Dec. 1, 2010 (PCT/KR2010/002222).
Creber, R. K. et al.; "Performance of Undersea Acoustic Networking Using RTS/CTS Handshaking and ARQ Retransmission"; Oceans, 2001 MTS/IEEE Conference and Exhibition; Nov. 5-8, 2001; Piscataway, NJ; IEEE, vol. 4; Nov. 5, 2001; pp. 2083-2086 (XP010566758).
European Search Report dated Oct. 14, 2011 issued in Application No. 09 73 8950.
International Search Report issued in Application No. PCT/KR2011/000311 dated Jul. 28, 2011.
U.S. Office Action issued in U.S. Appl. No. 12/431,893 dated Jul. 31, 2012.
Notice of Allowance issued in U.S. Appl. No. 12/842,679 dated Aug. 1, 2012.
U.S. Office Action issued in U.S. Appl. No. 12/431,903 dated Aug. 2, 2012.
U.S. Office Action issued in U.S. Appl. No. 12/432,184 dated Aug. 7, 2012.
Russian Office Action dated Feb. 7, 2012. (with translation).
U.S. Office Action issued in U.S. Appl. No. 12/431,903 dated Mar. 8, 2012.
U.S. Office Action issued in U.S. Appl. No. 12/431,893 dated Mar. 19, 2012.
U.S. Office Action issue din U.S. Appl. No. 12/432,132 dated Mar. 20, 2012.
U.S. Office Action issued in U.S. Appl. No. 12/757,205 dated Apr. 2, 2012.
International Search Report dated Dec. 18, 2009 issued in Application No. PCT/KR2009/002288.
International Search Report dated Dec. 21, 2009 issued in Application No. PCT/KR2009/002199.
International Search Report dated Jan. 4, 2010 issued in Application No. PCT/KR2009/002211.
International Search Report dated Aug. 23, 2010 issued in Application No. PCT/KR2010/000319.
U.S. Office Action issued in U.S. Appl. No. 12/432,111 dated Nov. 15, 2012.
Chinese Office Action dated Nov. 16, 2012.
U.S. Office Action issued in U.S. Appl. No. 12/431,910 dated Dec. 5, 2012.
U.S. Office Action issued in U.S. Appl. No. 12/757,213 dated Dec. 13, 2012.
U.S. Office Action issued in U.S. Appl. No. 12/432,132 dated Dec. 19, 2012.
U.S. Office Action issued in U.S. Appl. No. 12/850,240 dated Dec. 27, 2012.
U.S. Office Action issued in U.S. Appl. No. 12/846,013 dated Dec. 28, 2012.
U.S. Notice of Allowance issued in U.S. Appl. No. 12/847,303 dated Jan. 11, 2013.
U.S. Office Action issued in U.S. Appl. No. 12/431,903 dated Jan. 2, 2013.
U.S. Office Action issued in U.S. Appl. No. 12/757,246 dated Jan. 17, 2013.
U.S. Office Action issued in U.S. Appl. No. 12/431,893 dated Jan. 29, 2013.
Korean Office Action dated Aug. 13, 2012.
Japanese Office Action dated Sep. 11, 2012.
Notice of Allowance issued in U.S. Appl. No. 12/757,205 dated Sep. 14, 2012.
U.S. Office Action issued in U.S. Appl. No. 12/847,303 dated Sep. 14, 2012.
European Search Report dated Dec. 17, 2012.
European Search Report dated Jan. 2, 2013.
Ethem M Sözer; "Simulation and Rapid Prototyping Environment for Underwater Acoustic Communications: Reconfigurable Modem"; Oceans-Europe 2005; MIT Sea Grant College Program; Cambridge, MA, 02139; IEEE; pp. 80-85 (XP10838461A).
U.S. Office Action issued in U.S. Appl. No. 12/757,339 dated Jan. 31, 2013.
European Search Report dated Jan. 31, 2013. (10761908.2).
European Search Report dated Jan. 31, 2013. (10797292.9).
Japanese Office Action dated Feb. 12, 2013. (with translation).
U.S. Office Action issued in U.S. Appl. No. 12/603,810 dated Feb. 13, 2013.
U.S. Office Action issued in U.S. Appl. No. 12/551,827 dated Mar. 11, 2013.
U.S. Office Action issued in U.S. Appl. No. 12/842,649 dated Mar. 22, 2013.
U.S. Office Action issued in U.S. Appl. No. 12/846,013 dated May 7, 2013.
U.S. Notice of Allowance issued in U.S. Appl. No. 12/603,810 dated Jun. 12, 2013.
U.S. Office Action issued in U.S. Appl. No. 12/432,111 dated Jun. 13, 2013.
U.S. Office Action issued in U.S. Appl. No. 12/847,272 dated Jun. 27, 2013.
U.S. Office Action issued in U.S. Appl. No. 12/757,213 dated Jun. 28, 2013.
U.S. Office Action issued in U.S. Appl. No. 12/847,284 dated Jun. 28, 2013.
U.S. Office Action issued in U.S. Appl. No. 12/847,406 dated Jul. 9, 2013.
U.S. Office Action issued in U.S. Appl. No. 12/847,306 dated Jul. 9, 2013.
U.S. Appl. No. 12/432,184, filed Apr. 9, 2010.
Chinese Office Action dated Jun. 27, 2013.
U.S. Office Action issued in U.S. Appl. No. 12/431,893, dated Jul. 30, 2013.
U.S. Office Action issued in U.S. Appl. No. 12/757,339, dated Sep. 6, 2013.
Korean Notice of Allowance dated Aug. 30, 2013.
U.S. Office Action issued in U.S. Appl. No. 12/842,649, dated Oct. 8, 2013.
Russian Office Action issued in Application No. 2010144513/08 dated Jun. 27, 2012.
U.S. Office Action issued in U.S. Appl. No. 12/432,132 dated Aug. 15, 2012.
U.S. Office Action issued in U.S. Appl. No. 12/551,827 dated Aug. 16, 2012.
Notice of Allowance issued in U.S. Appl. No. 12/846,040 dated Aug. 17, 2012.
U.S. Appl. No. 12/431,893, filed Apr. 29, 2009.
U.S. Appl. No. 12/431,903, filed Apr. 29, 2009.
U.S. Appl. No. 12/431,910, filed Apr. 29, 2009.
U.S. Appl. No. 12/432,111, filed Apr. 29, 2009.
U.S. Appl. No. 12/432,132, filed Apr. 29, 2009.
U.S. Appl. No. 12/551,827, filed Sep. 1, 2009.
U.S. Appl. No. 12/757,339, filed Apr. 9, 2010.

(56) References Cited

OTHER PUBLICATIONS

U.S. Appl. No. 12/568,022, filed Sep. 28, 2009.
U.S. Appl. No. 12/757,205, filed Apr. 9, 2010.
U.S. Appl. No. 12/757,213, filed Apr. 9, 2010.
U.S. Appl. No. 12/757,246, filed Apr. 9, 2010.
U.S. Appl. No. 12/603,810, filed Oct. 22, 2009.
U.S. Appl. No. 12/432,184, filed Apr. 29, 2009.
U.S. Appl. No. 13/382,334, filed Jan. 5, 2012.
U.S. Appl. No. 13/808,414, filed Jan. 4, 2013.
U.S. Appl. No. 13/808,403, filed Jan. 4, 2013.
U.S. Appl. No. 12/842,649, filed Jul. 23, 2010.
U.S. Appl. No. 12/842,679, filed Jul. 23, 2010.
U.S. Appl. No. 12/846,013, filed Jul. 29, 2010.
U.S. Appl. No. 12/846,040, filed Jul. 29, 2010.
U.S. Appl. No. 12/847,272, filed Jul. 30, 2010.
U.S. Appl. No. 12/847,303, filed Jul. 30, 2010.
U.S. Appl. No. 12/847,406, filed Jul. 30, 2010.
U.S. Appl. No. 12/847,284, filed Jul. 30, 2010.
U.S. Appl. No. 12/847,306, filed Jul. 30, 2010.
U.S. Appl. No. 12/850,240, filed Aug. 4, 2010.
U.S. Appl. No. 13/522,066, filed Jul. 13, 2012.
U.S. Appl. No. 13/562,704, filed Jul. 31, 2012.
U.S. Appl. No. 13/588,164, filed Aug. 17, 2012.
U.S. Appl. No. 13/922,669, filed Jun. 20, 2013.
U.S. Appl. No. 13/933,467, filed Jul. 2, 2013.
Chinese Office Action dated Oct. 10, 2013.
U.S. Notice of Allowance issued in U.S. Appl. No. 12/846,013, dated Nov. 5, 2013.

* cited by examiner (a)

(b)

(a)

(b)

SYSTEM AND METHOD FOR DIAGNOSING HOME APPLIANCE

CROSS-REFERENCE TO RELATED APPLICATION

This application claims the benefit of U.S. Patent Application No. 61/168,366 filed on Apr. 10, 2009 in the USPTO, and Korean Patent Application No. 10-2009-0031501, filed on Apr. 10, 2009 in the Korean Intellectual Property Office, the disclosure of which is incorporated herein by reference.

BACKGROUND OF THE INVENTION

1. Field of the Invention

The present invention relates to a system and method for diagnosing a home appliance, and more particularly to a system and method for diagnosing a home appliance, which check a current status of the home appliance by analyzing product information that is output as a predetermined sound from the home appliance, such that after-sale service for the home appliance is facilitated.

2. Description of the Related Art

While a home appliance carries out a specific operation, it stores setup values required for the specific operation, information generated by the operation, malfunction or faulty operation information, etc. Specifically, the home appliance outputs a predetermined alarm sound signal when a malfunction or faulty operation occurs, such that a user who uses the home appliance can easily recognize a status of the home appliance. The home appliance informs the user of the operation completion or the malfunction occurrence, and at the same time outputs detailed malfunction information through an output unit (e.g., a display unit or a lamp).

In the meantime, if a malfunction or faulty operation occurs in the home appliance, the user informs an after-sale service center of the occurrence of malfunction or faulty operation by phone or E-mail, such that the user may ask advice of a service technician or ask the service technician to repair the faulty home appliance.

Generally, malfunction or fault information may be output externally through the home appliance, or may also be output as a fault code unknown to the user, such that the user has difficulty in properly solving such malfunction or fault of the home appliance. Although the user communicates with a service technician who works for the service center by phone or E-mail, the user may have difficulty in correctly explaining a faulty operation status of the home appliance to the service technician, such that the service technician may also have difficulty in providing a correct solution to the user. Although the service technician visits a home of the user who has requested after-sale service, the service technician does not recognize a correct status of the home appliance to be repaired, so that the repair of the home appliance generally takes a long time and much cost. For example, if the service technician who visits the home of the user does not have an appropriate component needed to repair the home appliance, the service technician must re-visit the corresponding home later after returning to the service center to retrieve the appropriate component, resulting in the occurrence of greater inconvenience and a long repair time.

In order to solve the above-mentioned problems, the home appliance may be connected to a server of the service center through a predetermined communication unit. However, a communication network must be implemented between each home and the service center.

U.S. Pat. No. 5,987,105 has disclosed an appliance communication system that converts fault information into a sound signal having an audible frequency transmissible over a telephone network, and transmits the sound signal to the service center or the like through a telephone.

However, the above-mentioned related art disclosed in the U.S. Pat. No. 5,987,105 has difficulty in correctly detecting data when a sound signal is analyzed and diagnosed. In conclusion, there is needed an improved technology that allows a home appliance to output information using a sound signal, transmits the sound signal to a service center through a telephone line, and diagnoses a current status of the home appliance and the presence or absence of a faulty operation in such a manner that correct data detection is provided.

SUMMARY OF THE INVENTION

Accordingly, the present invention is directed to a diagnostic system and method for a home appliance that substantially obviate one or more problems due to limitations and disadvantages of the related art.

Therefore, the present invention has been made in view of the above problems, and it is an object of the present invention to provide a system and method for diagnosing a home appliance. When the diagnostic system receives a sound signal from the home appliance and detects product information from the received sound signal, it generates multiple symbol clocks having a time difference therebetween and establishes the multiple symbol clocks with the sound signal, such that it correctly detects a preamble and data.

In accordance with an aspect of the present invention, the above and other objects can be accomplished by the provision of a diagnostic system for a home appliance including at least one home appliance for outputting product information as a sound signal, and a diagnostic server for receiving the sound signal from the home appliance and diagnosing a faulty operation of the home appliance using the received sound signal, wherein the diagnostic server detects the product information using a plurality of synchronous signals generated at intervals of a predetermined time, and diagnoses a current status of the home appliance, a faulty operation, and the cause of the faulty operation through the product information.

In accordance with another aspect of the present invention, there is provided a diagnostic method for use in a diagnostic system of a home appliance including receiving a sound signal generated from the home appliance, detecting a post-preamble estimated as a preamble from the sound signal, and generating a plurality of synchronous signals at intervals of a unit time in response to the post preamble, detecting product information contained in the sound signal by extracting a data candidate for each synchronous signal in response to the plurality of synchronous signals and checking an error of the data candidate, and diagnosing a status of the home appliance by analyzing the product information.

As described above, the diagnostic system and method for the home appliance according to the present invention generate multiple synchronous signals having a time difference therebetween upon receiving a sound signal from the home appliance, and detect a preamble and data from the sound signal using the multiple synchronous signals. As a result, the diagnostic system can effectively detect product information, increase the accuracy of product information, and quickly and correctly diagnose a faulty operation of the home appliance.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

Now, exemplary embodiments of the present invention will be described in detail with reference to the annexed drawings.

Figure 1:
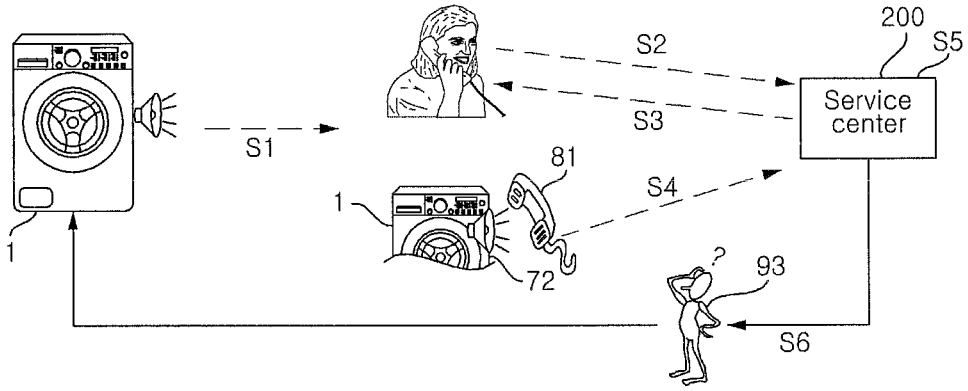
FIG. 1 schematically illustrates a diagnostic system including a home appliance according to one embodiment of the present invention.

FIG. 1 schematically illustrates a diagnostic system including a home appliance according to one embodiment of the present invention.

Referring to FIG. 1, the diagnostic system includes a home appliance 1 separately installed at each place and a diagnostic server for diagnosing a status and fault of the home appliance.

The home appliance 1 includes a display unit and a sound output unit for outputting a predetermined sound.

If product information or status information of the home appliance 1 is output as a sound through the home appliance 1 installed at each home, a sound signal including the product information and the status information is transmitted to the diagnostic server of a service center 200 through a telephone line, such that the diagnostic server can diagnose the presence or absence of a faulty operation in the home appliance.

A user recognizes product information of the home appliance 1 through an output unit of the home appliance 1, controls operations of the home appliance 1, or requests after-sale service from the service center 200 at step S2.

The user who has a home appliance 1 to be repaired communicates with the service center by phone, E-mail or other mode of communication, receives an instruction message from a counselor or adviser of the service center at step S3, and operates an input unit embedded in the home appliance 1, such that the home appliance 1 outputs a sound signal detailing product information at step S4, and transmits the sound signal to the service center. In this case, the home appliance 1 according to the present invention is not limited only to a specific function for outputting product information, and is extended to another function for converting the product information into a predetermined sound signal and thus outputting the resultant sound signal.

In other words, when the user establishes a call connection with an adviser of the service center 200 at steps S2 and S3, the user moves a phone 81 close to an audible part of the home appliance 1, such that a sound signal S1 including product information or status information that is output when a malfunction or fault occurs in the home appliance 1 is transferred to the service center through a telephone line at step S4.

The adviser of the service center allows the home-appliance sound signal received through the telephone line to be stored in a diagnostic server. The diagnostic server analyzes the sound signal and thus diagnoses a product status of the home appliance 1 and the presence or absence of a faulty operation in the home appliance 1 at step S5.

In response to the diagnosis result of the home appliance 1, the service center 200 sends a service technician or repairman 93 to a home of the user who requested the after-sale service, such that the service technician can provide the user with a repair service suitable for a product status or a diagnosed fault at step S6. In this case, the diagnosis result is transferred to a portable terminal of the service technician 93 such that the service technician 93 can repair a faulty operation of the home appliance 1. Otherwise, the diagnosis result may also be transferred to the user through the adviser of the service center. In addition, the diagnosis result may be transferred to the user by E-mail or may also be transferred to the portable terminal of the user.

Therefore, if the user establishes a call connection with the service center through a communication network (e.g., a telephone line), the diagnostic system correctly recognizes a current status of the home appliance 1 through the sound signal and properly copes with the recognized status, such that a necessary service can be quickly provided to the user.

Now, although the term 'home appliance' disclosed in the present invention is exemplarily set to a washing machine for convenience of description and better understanding of the present invention, the scope or spirit of the term 'home appliance' is not limited thereto, but is applicable to other home appliances, for example, a television, a refrigerator, an electric rice cooker, a microwave oven, and the like.

The home appliance 1 can be configured as follows to output product information as a predetermined sound signal, such that the diagnostic server can diagnose the status or fault of the home appliance 1 on the basis of the sound signal including the product information.

Figure 2:
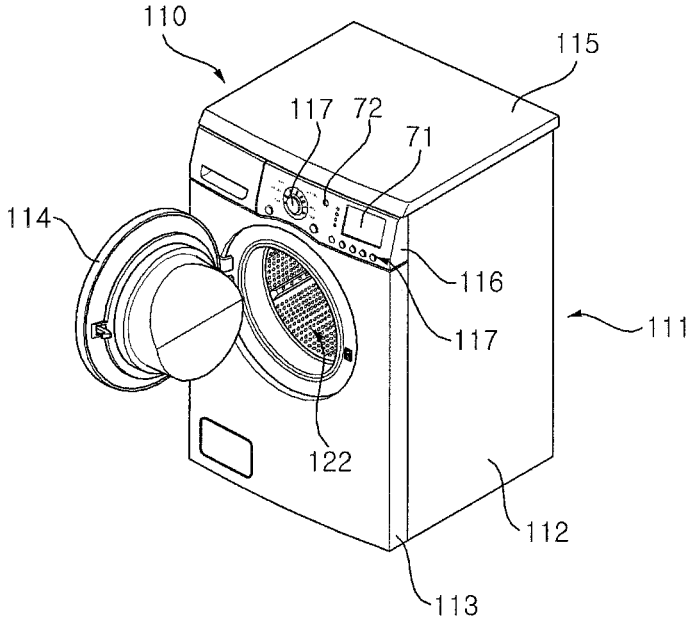
FIGS. 2(*a*) and 2(*b*) illustrate a home appliance and a relationship between the home appliance and a service center according to one embodiment of the present invention.
Figure 2:
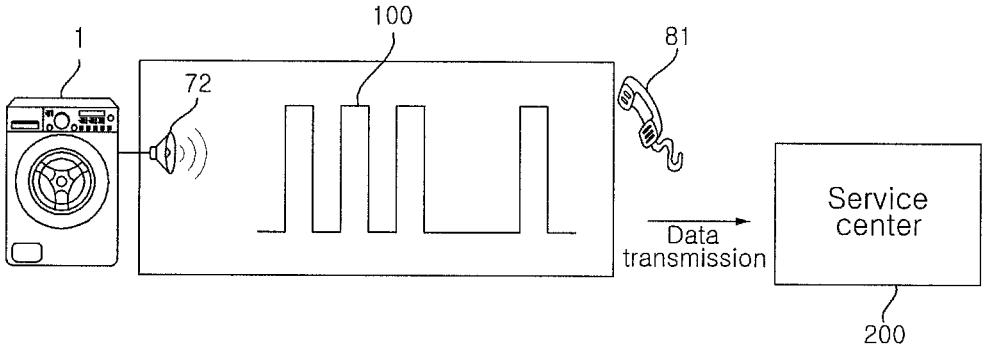

FIGS. 2(*a*) and 2(*b*) illustrate a home appliance and a relationship between the home appliance and a service center according to one embodiment of the present invention.

As one example of the home appliance, a washing machine will be described in detail. Referring to FIG. 2(*a*), the washing machine 1 includes a cabinet 111, a tub 122 installed in the cabinet 111 to clean laundry or clothes, a motor (not shown) for driving the tub 122, a water provider (not shown) for providing clean water to the tub 122, and a drainage unit (not shown) for draining dirty or soiled water generated during the laundry cleaning.

The cabinet 111 includes a cabinet frame 112, a cabinet cover 113 that is located at an upper part of the cabinet frame 112 and is coupled to the cabinet frame 112, a control panel 116 that is located at an upper part of the cabinet cover 113 and controls operations of the washing machine, and a top plate 115 that is located at an upper part of the control panel 116 and coupled to the cabinet frame 112. The cabinet cover 113 includes a hole (not shown) via which laundry is placed in or withdrawn from the tub 122, and a door 114 that rotates to open or close the hole.

The control panel 116 includes a plurality of operation keys or buttons 117 to control operations of the washing machine 1, a sound output unit 72 for outputting a sound indicating an operation status of the washing machine 1, and a display unit 71 for displaying the operation status in the form of an image.

Referring to FIG. 2(*b*), if a faulty operation occurs in the washing machine 1, information about the faulty operation may be displayed on the display unit 71, or an alarm sound may be output. Therefore, if the faulty operation occurs in the washing machine 1, the user of the washing machine 1 communicates with the service center 200, receives an instruction message from an adviser of the service center, and thus properly handles or operates an operating unit 22 according to the received instruction message.

If the user presses the operating unit 22 of the washing machine 1, a signal output command is input to the washing machine 1, a digital signal including product information is generated, the digital signal is converted into a modulated signal through the converter 60, and the modulated signal is output as a predetermined sound signal through the sound output unit 72.

In this case, the sound signal 100 output from the sound output unit 72 is transferred to the service center 200 through a portable terminal 81 connected to a predetermined communication network. For example, the communication network may be a telephone network or a mobile communication network, and the portable terminal 81 may be a telephone or a mobile terminal.

The service center 200 analyzes the sound signal received from the portable terminal 81, and obtains operation information and fault information of the home appliance 1. Therefore, the service center may transmit a solution for obviating a faulty operation of the home appliance 1 to the user, or may dispatch a service technician to the user.

Figure 3:
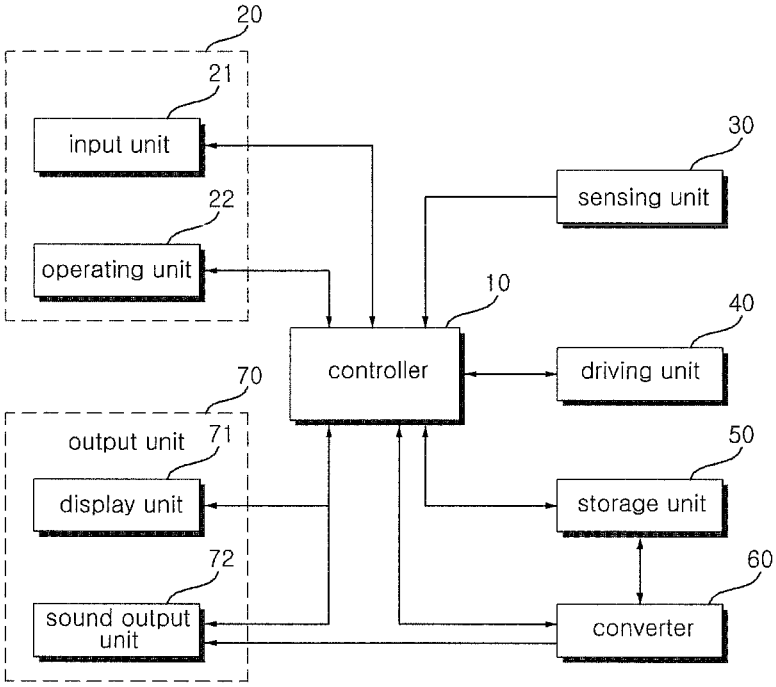
FIG. 3(*a*) is a block diagram of a home appliance and FIG. 3(*b*) is a block diagram illustrating a diagnostic server according to one embodiment of the present invention.
Figure 3:
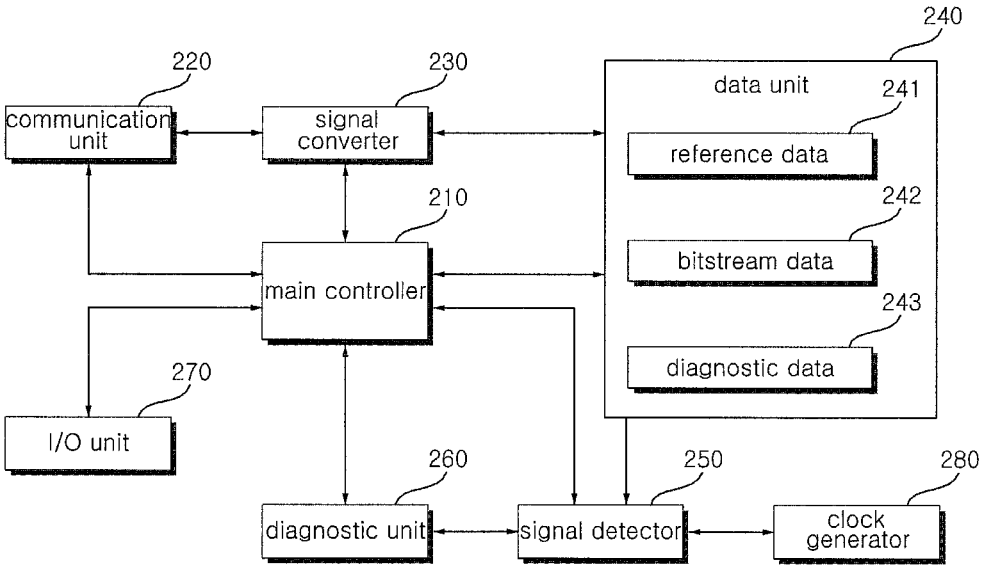

FIG. 3 illustrates a home appliance and a diagnostic server according to one embodiment of the present invention. In more detail, FIG. 3(*a*) is a block diagram of the home appliance 1 and FIG. 3(*b*) is a block diagram illustrating the diagnostic server according to one embodiment of the present invention.

The aforementioned washing machine 1 may further include the following control elements. Referring to FIG. 3(*a*), the washing machine 1 includes an input unit 21, an operating unit 22, a sensing unit 30, a driving unit 40, a storage unit 50, a converter 60, an output unit 70, and a controller 10 for controlling overall operations of the washing machine 1. In this case, the output unit 70 may include a display unit 71 and a sound output unit 72.

The driving unit 40 receives a control command from the controller 10, and thus performs a predetermined operation in response to the received control command. In the case of the washing machine, the driving unit 40 drives and controls a motor for rotating a washing tub or drum in such a manner that pollutants or contaminants can be separated from laundry by rotation of the tub or drum. In addition, upon receiving a control command from the controller 10, the driving unit 40 controls valves to perform a water-supply function or a drainage function.

The sensing unit 30 includes at least one sensor. When the washing machine 1 performs a predetermined action via the driving unit 40, the sensing unit 30 measures data for checking an operation status of the washing machine 1 and transmits the measured data to the controller 10.

The storage unit 50 stores operation status data generated when the washing machine 1 performs a predetermined operation, stores operation information (e.g., setup data) received from the input unit 21 to allow the washing machine 1 to perform a predetermined operation, and also stores fault information as to the cause of the fault or the faulty part when a faulty operation occurs in the washing machine 1.

In addition, the storage unit 50 stores control data for controlling operations of the washing machine 1 and reference data used for operation control. The storage unit 50 may further store status information of each sensor contained in the sensing unit 30 and measurement data of each sensor.

The operating unit 22 includes at least one input unit, receives a signal output command for controlling product information to be generated as a predetermined sound signal through the sound output unit 72, and outputs the signal output command to the controller 10. The operating unit 22 receives the signal output command so that it controls the sound output unit 72 to be switched on or off in response to the signal output command. In other words, upon receiving the signal output command from the operating unit 22, the washing machine outputs a predetermined sound signal indicating product information in response to a digital signal generated from the controller 10. In this case, the sound output unit 72 may be used to output the predetermined sound signal.

The input unit 21 may receive setup information related to the output of such a sound signal. In more detail, the input unit 21 may receive a variety of setup values indicating a method for generating a sound signal, a volume of the generated sound signal, etc.

The user input part 20 such as the operating unit 22 or the input unit 21 may be configured to include buttons, a dome switch, a touch pad (including a static-pressure type and an electrostatic type), a jog wheel, a jog switch, a finger mouse, a rotary switch, a jog dial, or the like. Any device is applicable as the input portion 20 so long as it generates predetermined input data by manipulation such as pressure, rotation, contact, etc.

The controller 10 receives a signal output command from the operating unit 22, generates a digital signal including product information by retrieving product information stored in the storage unit 50, applies the generated digital signal to the converter 60, and converts the digital signal including product information into a specific modulated signal. Upon receiving the signal output command from the operating unit 22, the controller 10 controls the sound output unit 72 to be operated.

In this case, the product information may include operation information and fault operation, wherein the operation information includes information about an operation setup and information about an operation status, and the fault operation includes information about a malfunction or faulty operation. The product information may be data composed of a combination of 0s and 1s, and may be a digital signal readable by the controller 10.

The converter 60 converts a digital signal including product information into a modulated signal for outputting a sound signal. In this case, the converter 60 converts the product information denoted by a digital signal into an analog signal having a predetermined frequency band. During the signal conversion, the converter 60 converts a digital signal into a modulated signal using any one of a frequency shift keying (FSK) scheme, an amplitude shift keying (ASK) scheme, and a phase shift keying (PSK) scheme.

In this case, the frequency shift keying scheme converts an input signal into a predetermined-frequency signal in response to a data value of product information. The amplitude shift keying scheme converts an input signal into another signal that has different amplitudes according to data values. The phase shift keying scheme converts an input signal into another signal that has different phases according to data values of product information.

The converter 60 converts a digital signal including product information into a signal of a predetermined frequency band according to the above-mentioned scheme, combines individual modulated signals with each other, and outputs the combined modulation signal.

In this case, the generated sound signal may include product information and a preamble indicating the beginning of data including the product information in a header part of data, and this data includes not only product information but also a check bit for detecting errors in data. When product information of the home appliance is output as a modulated signal, the sound signal is divided into a plurality of frames and a preamble is inserted into each frame.

The sound output unit 72 is switched on or off under the control of the controller 10, receives a modulated signal from the converter 60, and thus outputs a predetermined sound signal. For example, the sound output unit 72 may be a speaker or a buzzer to output the sound signal.

The sound output unit 72 outputs a modulated signal as a sound signal. If the output of the sound signal is completed, the sound output unit 72 stops operation. If a signal output command is input to the sound output unit 72 through the operating unit 22, the sound output unit 72 is re-operated so that it outputs a predetermined modulated signal.

In response to a control signal of the controller 10, the display unit 71 displays input information entered by the operating unit 22 and the input unit 21, information about an operation status of the washing machine 1, and information about the completion of a home-appliance operation on the screen. In addition, the display unit 71 displays information about a faulty operation of the home appliance on the screen.

In this case, the output unit 70 may further include the sound output unit 72, the display unit 71, a lamp being switched on or off, a vibration element, and the like, and a detailed description thereof will be omitted herein.

The above-mentioned washing machine 1 outputs a predetermined sound signal, such that it can transmit product information of the washing machine 1 to the service center 200 according to the following description.

If product information of the washing machine 1 is output as a sound signal and is transmitted to the service enter 200 through a telephone network, the product information is input to the diagnostic server of the service center 200 such that the diagnostic server can diagnose a faulty operation of the washing machine 1.

Referring to FIG. 3(*b*), the diagnostic server may include a communication unit 220, a signal converter 230, a data unit 240, an input/output (I/O) unit 270, a signal detector 250, a clock generator 280, a diagnostic unit 260, and a main controller 210 for controlling overall operations of the diagnostic server.

The I/O unit 270 may include an input unit pressed by a user of the service center 200, for example, buttons, keys, a touch pad, a switch, etc. The I/O unit 270 may further include a display unit for outputting not only operation information of the diagnostic server but also the diagnosis result. The I/O unit 270 may include an external input device and an interface for accessing a portable memory unit.

If the input unit is pressed or manipulated, the I/O unit 270 transmits a signal to the main controller 210, and allows a sound signal of the washing machine to be transferred from a telephone or portable terminal of a user who connects to a telephone network to the diagnostic server.

The communication unit 220 is connected to a network of the service center so that it transmits and receives data to and from the service center over the network. The communication unit 220 is connected to an external network such as the Internet so that it communicates with the external network. Specifically, if a record command or a reception command is input to the communication unit 220 through the input unit according to a control command of the main controller 210, the communication unit 200 receives a sound signal and transmits the diagnosis result to an external part through a telephone network.

The data unit 240 includes bitstream data 242, reference data 241, and diagnostic data 243. The bitstream data 242 includes control data for operating the diagnostic server and sound-signal data received from the home appliance such as the washing machine. The reference data 241 detects product information of a home appliance from the sound-signal data. The diagnostic data 243 is used to diagnose the presence or absence of a fault and the cause of the fault.

In this case, the data unit 240 receives the reference data 241, the bitstream data 242, the diagnostic data 243, and the home appliance data 244 from the main controller 210, and manages and updates the received data 241 to 244.

The signal converter 230 converts analog data indicating the received sound signal into other data, and stores the converted data as the bitstream data 242. In this case, the signal conversion performed by the signal converter 230 may be identical to inverse conversion of a previous signal conversion performed by the home appliance 1. Preferably, a mutual agreement is provided between each home appliance and the diagnostic server, so that each home appliance and the diagnostic server may perform data conversion using the same signal conversion system. The signal converter 230 may convert an analog signal (i.e., a sound signal) of a predetermined frequency band into a digital signal through inverse conversion based on any one of a frequency shift keying scheme, an amplitude shift keying scheme, and a phase shift keying scheme.

The signal detector 250 firstly detects a preamble indicating the beginning of data from the bitstream converted by the signal converter 230, detects data including product information on the basis of the detected preamble, and transmits the detected data as the home appliance data 244 in the data unit 240. The signal detector 250 detects a preamble and data on the basis of the size of a preamble contained in the reference data 241 and the reference data 242 related to the data size.

If the signal detector 250 detects a signal estimated as a preamble, it transmits a clock generation command to the clock generator 280. The signal detector 250 detects a preamble and data in response to a predetermined preamble size and a predetermined data size using a symbol clock generated by the clock generator 280.

The signal detector 250 controls the clock generator 280 to generate a plurality of symbol clocks in units of a predetermined time. The signal detector 250 detects a preamble and data in response to each symbol clock from the bitstream using the generated symbol clocks as a synchronous signal.

The signal detector 250 checks errors of a plurality of data units using the check bit contained in the detected data, detects normal data from the plurality of data units according to a plurality of symbol clocks, and discards erroneous data.

Figure 4:
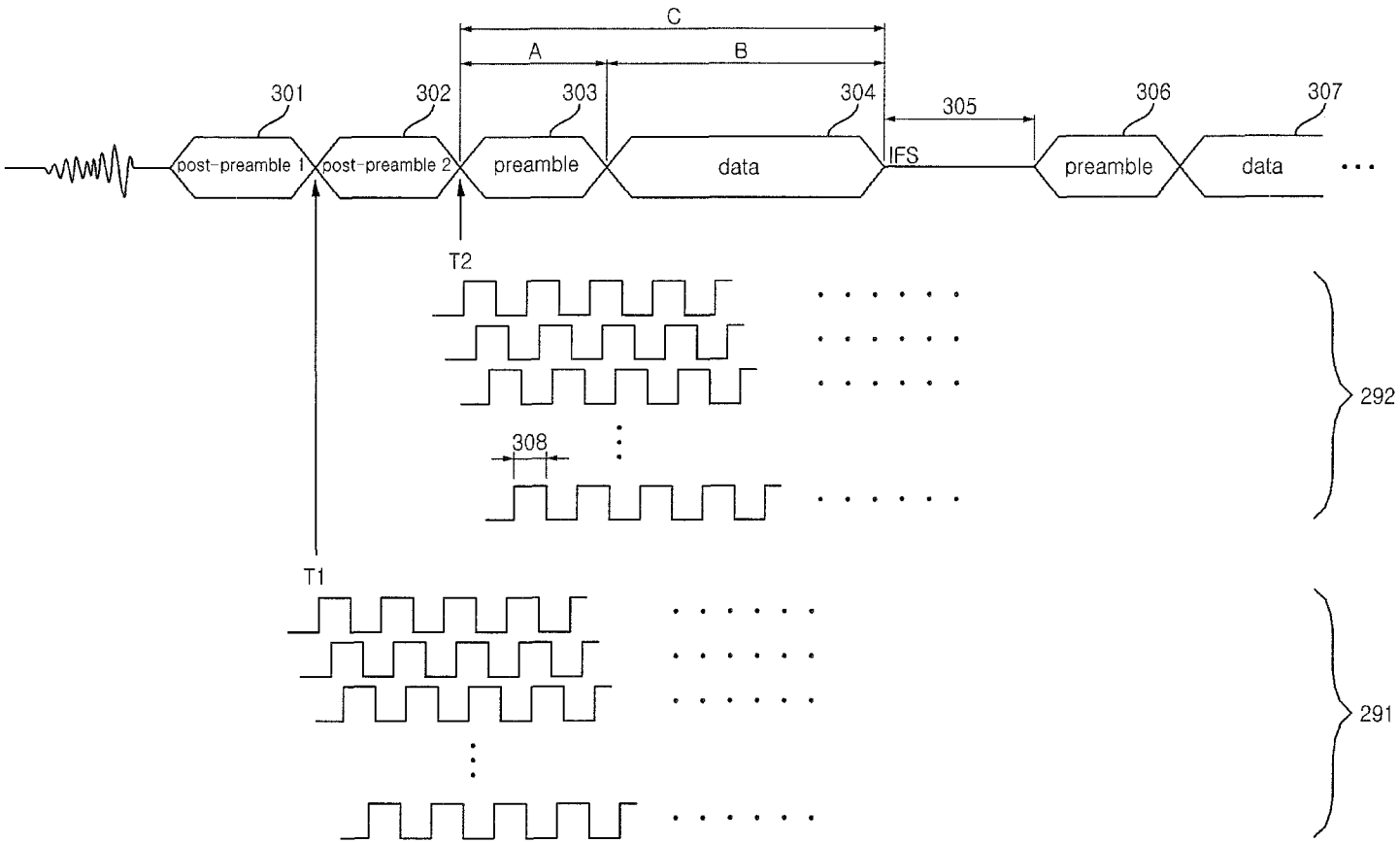
FIG. 4 illustrates an example of a method for detecting a preamble and data using a synchronous signal of a diagnostic server according to one embodiment of the present invention.

In this case, the signal detector 250 transmits a clock generation command to the clock generator 280 at the end part of a first post-preamble 1 recognized as a preamble as shown in FIG. 4, and transmits the clock generation command to the clock generator 280 at the end part of a second post-preamble 2.

Upon receiving the clock generation command from the signal detector 250, the clock generator 280 generates a symbol clock in units of a predetermined time. In this case, the clock generator generates 9 symbol clocks in units of a predetermined time of 0.5 msec in response to one clock generation command. In this case, the symbol clock generation period and the number of symbol clocks may be changed according to setup data.

The signal detector 250 applies two clock generation commands to the clock generator 280 so as to detect one preamble. In this case, 9 clock generation commands are applied to the clock generator 280 two times, so that each of a total of 18 symbol clocks is used as a synchronous signal, and thus detects a preamble and data from a bitstream of the sound signal.

The diagnostic unit 260 analyzes data detected by the signal detector 250, determines a current status and fault of the home appliance 1 using product information contained in the analyzed data, analyzes the cause of the fault, and finally outputs the diagnosis result of the fault. In this case, the diagnostic unit 260 diagnoses the current status and fault of the home appliance 1 using a diagnostic algorithm contained in the diagnostic data 243 and a reference value caused by the diagnosis.

The main controller 210 controls transmission and reception of data through the communication unit 220, controls the flow of data through the I/O unit 270, converts the sound signal including product information of the home appliance into other data through the signal converter 230, and controls the signal detector 250 to detect the converted resultant data. The main controller 210 transmits a control command to each part in such a manner that the diagnostic unit 260 diagnoses a faulty operation of the home appliance using the detected data. The main controller 210 may output a diagnosis result of the diagnostic unit 260 through the I/O unit 270, or may control the diagnosis result to be transmitted through the communication unit 220.

FIG. 4 illustrates an example of a method for detecting a preamble and data using a synchronous signal of a diagnostic server according to one embodiment of the present invention.

Referring to FIG. 4, the home appliance 1 outputs a sound signal, and the output sound signal is received in the diagnostic server of the service center through a telephone network or the like. The diagnostic server converts the sound signal into a bitstream, and stores the bitstream in the data unit 240. The signal detector 250 detects a preamble and data from the bitstream.

In this case, the bitstream includes noise, preambles 303 and 306 and data 304 and 307. One preamble and one data form one frame C, and an IFS 305 is located between frames.

Individual data of each frame may include some parts of product information of the home appliance, several data units are collected to form product information for diagnosing the home appliance. If the diagnostic unit 260 detects all data for diagnosing a fault of the home appliance, it analyzes product information contained in the data and diagnoses the fault.

If the signal detector 250 recognizes the post-preamble 301 estimated as a preamble, it transmits a clock generation command to the clock generator 280 in response to the predetermined preamble size A at a first time T1 at which the first post-preamble 1 is ended. If a second post-preamble 302 estimated as a next preamble is recognized, the signal detector 250 transmits a clock generation command to the clock generator 280 at a second time T2 at which the second post-preamble 302 is ended.

Therefore, the clock generator 280 generates a plurality of symbol clocks in units of a predetermined time, generates 9 symbol clocks in units of a predetermined time 308 on the basis of the first time T1 (See '291'), and generates 9 reference clocks on the basis of a second time T2 (See '292'). In this case, the unit time for generating the symbol clock is exemplarily set to 0.5 msec for convenience of description and better understanding of the present invention, and a time unit for generating the symbol clock may be changed according to the symbol size.

In this case, the signal detector 250 incorrectly detects the preamble at an initial time and recognizes the first and second post-preambles 301 and 302 instead of an actual preamble. Therefore, the signal detector 250 uses 9 symbol clocks generated from the first time T1 and 9 symbol clocks generated from the second time T2, namely, a total of 18 symbol clocks. The signal detector 250 can extract a data candidate from the bitstream using each symbol clock as a synchronous signal.

That is, the signal detector 250 extracts 18 candidates by multiple symbol clocks having a time difference therebetween, such that it detects data and a preamble from the candidates.

In this case, each candidate may be extracted in response to the preamble size A and the data size B.

Figure 5:
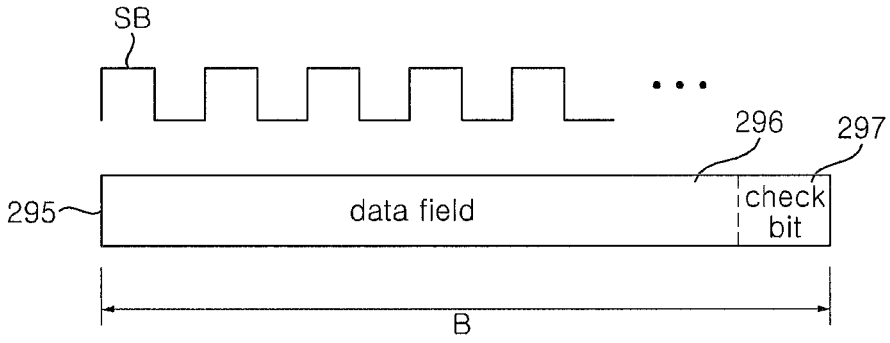
FIG. 5 illustrates an example of a method for detecting data using a symbol clock serving as a synchronous signal shown in FIG. 4 according to the present invention.

FIG. 5 illustrates an example of a method for detecting data using a symbol clock of FIG. 4 according to the present invention.

Referring to FIG. 5, a plurality of data candidates may be detected using the symbol clock of FIG. 4 as a synchronous signal. Each data candidate is extracted on the basis of a specific position at which a preamble is ended.

The data candidate 295 of one symbol clock (SB) may be extracted in response to the data size B, and includes not only a data field 296 including product information but also a check bit 297 for checking an error.

The signal detector 250 detects 18 data candidates of 18 symbol clocks 291, 292 and SB as shown in the scheme of FIG. 5, and checks the presence or absence of a data error using the check bit 297 contained in each data candidate.

In this case, the signal detector 250 detects a data candidate, that was recognized to have a normal status during an error check process based on the check bit 297, as normal data from among 18 data candidates which have been extracted using 18 symbol clocks as a synchronous signal. If normal data 304 is detected, the signal detector 250 may extract the preamble 303 by inversely employing the above method for detecting the normal data 304.

In this case, 17 candidates from among 18 candidates do not normally begin, so that each of the 17 candidates may be recognized as an error through the check bit, and even the check bit may have an unexpected error therein. For example, a preamble of '01110' and data of '101010111 . . . ' are recognized according to each symbol clock, so that a total of 18 extracted candidates are different from one another and only one candidate that is identical to a preamble of '01110' and data of '101010111 . . . ' exists.

The signal detector 250 detects each candidate of the next preamble 306 and the next data 306 using multiple symbol clocks having a time difference therebetween.

Figure 6:
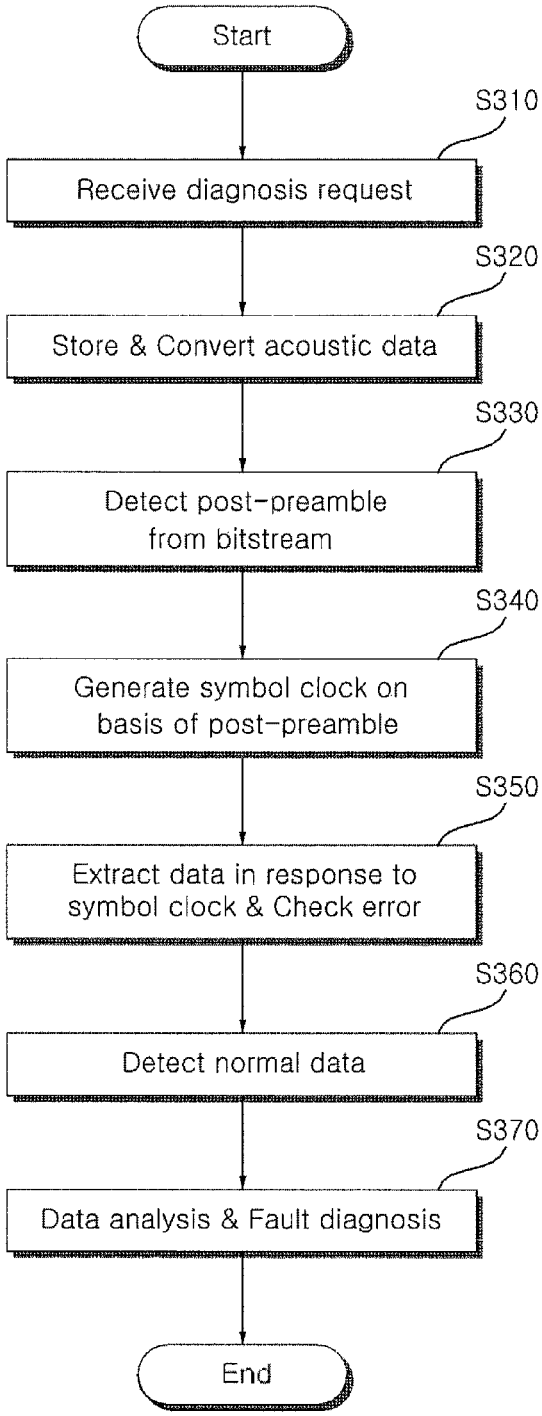
FIG. 6 is a flowchart illustrating a method for detecting a preamble by the diagnostic server according to the present invention.

FIG. 6 is a flowchart illustrating a method for detecting a preamble by the diagnostic server according to the present invention.

Referring to FIG. 6, the diagnostic server receives a diagnosis request and sound data from the service center S310. In this case, the signal converter 230 converts a sound signal serving as sound into bitstream data, and stores the bitstream data 243 in the data unit 240 at step S320.

If the signal detector 250 recognizes a signal estimated as a preamble in the bistream, it detects a corresponding signal as a post-preamble in response to the predetermined preamble size A at step S340 and outputs a clock generation command to the clock generator 280 on the basis of a specific position at which the post-preamble is ended.

Accordingly, the clock generator 280 generates a plurality of symbol clocks in units of a predetermined time.

If the other signal estimated as a preamble is detected, the signal detector 250 detects the second post-preamble 2 and outputs a clock generation command to the clock generator 280 in such a manner that symbol clocks are generated as described above.

The signal detector 250 uses multiple symbol clocks having a predetermined time difference therebetween as a synchronous signal of each bitstream, generates a data candidate for each symbol clock, and checks errors using the check bit in regard to a plurality of generated data candidates at step S350.

One data candidate recognized as normal data from among a plurality of data candidates is detected as data, and thus a preamble is detected at step S360. In this case, a symbol clock related to a normal data candidate may be set to a reference symbol clock for a corresponding frame. The remaining data candidates recognized as abnormal data candidates are discarded.

If all data for diagnosis is detected, the diagnostic unit 260 diagnoses a faulty operation in response to product information by analyzing data at step S370.

The main controller 210 may transmit a diagnosis result of the diagnostic unit 260 through the communication unit 220 or may control the diagnosis result to be output through the I/O unit 270. In this case, the diagnostic server may transmit the diagnosis result to a portable terminal of the service technician or may output the diagnosis result to the I/O unit 270.

Figure 7:
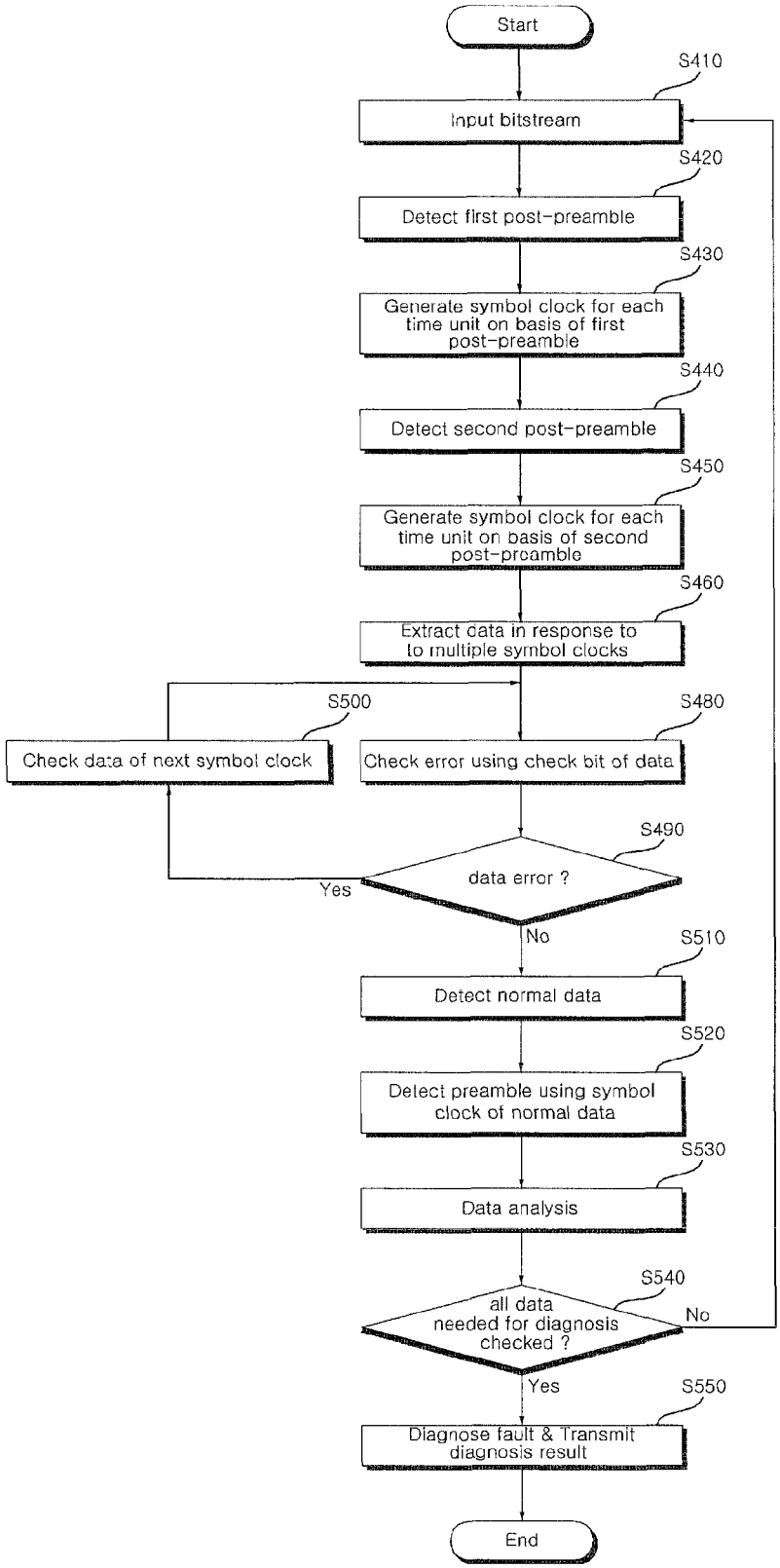
FIG. 7 is a flowchart illustrating a method for controlling the diagnostic server of FIG. 6 to detect a preamble and data using a synchronous signal according to the present invention.

FIG. 7 is a flowchart illustrating a method for detecting a preamble and data using a symbol clock of the diagnostic server shown in FIG. 6 according to the present invention.

Referring to FIG. 7, if a bitstream is input at step S410, the signal detector 250 recognizes the input bitstream and a signal estimated as a preamble, so that it detects a first post-preamble at step S420.

The preamble size is predefined, so that the signal detector 250 transmits a clock generation command to the clock generator 280 at a specific position where the first post-preamble 301 is ended. Accordingly, the clock generator 280 generates a plurality of symbol clocks having a time difference therebetween at step S430.

In addition, after the lapse of the first post-preamble 301, the signal detector 250 recognizes a signal estimated as a net preamble and thus detects a second post-preamble 302 at step S440. The signal detector 250 transmits the clock generation command to the clock generator 280 at a specific position where the second post-preamble 302 is ended, so that the clock generator 280 generates a plurality of symbol clocks at step S450.

In this case, in response to the clock generation command of the signal detector 250, the clock generator 280 generates 9 symbol clocks at intervals of a unit time of 0.5 msec from the first time T1 at which the first post-preamble 301 is ended, and generates 9 symbol clocks at intervals of a unit time of 0.5 msec from the second time T2 at which the second post-preamble 302 is ended, as shown in FIG. 4, such that 18 symbol clocks having a time difference therebetween are generated.

In this case, the unit time and the number of symbol clocks may be changed according to the symbol size and the data size each indicating one information. If the number of symbol clocks is increased, a processing speed is reduced in response to the increasing number of symbol clocks. However, if the number of symbol clock is reduced, the probability of detecting data is also reduced, so that it is preferable that the unit time and the number of symbol clock be determined according to the symbol size and the data size.

The signal detector 250 extracts data from the bitstream using multiple symbol clocks having a time difference as a synchronous signal at step S460. In this case, the symbol clocks are counted on the basis of a specific part where the post-preamble is ended, so that the signal detector 250 extracts a data candidate of each symbol clock.

A total of 18 symbol clocks are generated on the basis of the first time T1 and the second time T2, and the 18 symbol clocks are used so that a total of 18 data candidates are extracted. In regard to each data candidate, the signal detector 250 checks an error using the check bit 297 contained in data at step S480.

The signal detector 250 determines the presence or absence of an error in each data candidate at step S490, and discards an erroneous data candidate and checks a data candidate of the next symbol clock at step S500.

The signal detector 250 performs error check of all data candidates having been extracted by symbol clocks using the aforementioned check bit at steps S480 and 5490.

In this case, a predetermined-sized check bit is contained in the end part of data, so that it is estimated that the extracted data candidate is normal data on the basis of the check bit. Thus, the check bit is recognized according to the data size and the check-bit size, and an error check process is performed on the data using the check bit.

There is only one actual data from among several data candidates, and the remaining data is abnormal data, so that only one data candidate includes the check bit and is recognized as normal data.

The signal detector 250 sets a specific data candidate recognized as a normal data candidate to normal data at step S510, and can extract a preamble in an inverse order from a symbol clock of the normal data or data at step S520. In this case, the symbol clock of the normal data may be used as a reference clock within a corresponding frame.

The signal detector 250 stores the detected data in the data unit 240, the diagnostic unit 260 analyzes the data so as to check product information at step S530.

In this case, while all data needed for diagnosis is collected at step S540, the above method for detecting data using multiple symbol clocks having a time difference is repeatedly performed at steps S410 to S540.

The diagnostic unit 260 diagnoses a status of a home appliance, the presence or absence of a faulty operation, and a cause of the faulty operation using the product information contained in the data field 296 of each data 295, and thus generates a diagnosis result. The main controller 210 may output the diagnosis result through the I/O unit 270 or may transmit the diagnosis result to the portable terminal of the service technician 96.

Therefore, the user of the home appliance receives the diagnosis result, repairs a faulty operation of the home appliance according to the diagnosis result or calls a service technician from the service center to repair the faulty operation. The service technician who visits a home of the user receives the diagnosis result, checks a current status of the home appliance on the basis of the received diagnosis result, and repairs the faulty operation of the home appliance.

In conclusion, the system and method for diagnosing the home appliance according to the present invention generate a plurality of symbol clocks having a time difference, extract data using a symbol clock serving as a synchronous signal, and detect data through an error check action. As a result, the system or method can effectively detect data and increase the accuracy of detected data, resulting in accurate diagnosis of the home appliance.

As is apparent from the above description, the diagnostic system and method for the home appliance according to the present invention generate multiple synchronous signals having a time difference therebetween upon receiving a sound signal from the home appliance, and detect a preamble and data from the sound signal using the multiple synchronous signals. As a result, the diagnostic system can effectively detect product information, increase the accuracy of product information, and quickly and correctly diagnose a faulty operation of the home appliance.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A diagnostic system for a home appliance, comprising:

a diagnostic server configured to receive a sound signal including a product information from the home appliance and diagnose a faulty operation of the home appliance using the received sound signal, wherein the diagnostic server detects data corresponding to the product information using a plurality of synchronous signals generated at intervals of a predetermined time, and diagnoses a current status of the home appliance, a faulty operation, and a cause of the faulty operation through the product information, wherein the diagnostic server extracts a post-preamble estimated as a preamble, generates the plurality of synchronous signals on the basis of the post-preamble, and detects not only a preamble but also data corresponding to the product information on the basis of a predetermined preamble size and a predetermined data size, wherein the diagnostic server includes a clock generator that generates the plurality of synchronous signals at intervals of the predetermined time, and wherein the clock generator generates at least three synchronous signals, each of which corresponds to the post-preamble, at intervals of the predetermined time, and changes a time interval of generating each synchronous signal in response to a symbol time of the sound.

2. The diagnostic system according to claim 1, wherein the diagnostic server further includes:

a signal detector that, when detecting a post-preamble estimated as a preamble from a converted signal, allows the clock generator to generate the plurality of synchronous signals, detects a preamble and data from the sound signal on the basis of the plurality of synchronous signals, and extracts the product information through a combination of the data.

3. The diagnostic system according to claim 2, wherein the signal detector extracts a plurality of data candidates corresponding to each synchronous signal on the basis of the plurality of synchronous signals, checks an error of each data candidate using a check bit contained in each data candidate, discards an erroneous data candidate, and recognizes a normal data candidate as the data.

4. The diagnostic system according to claim 3, wherein the signal detector, upon receiving a result of the error check, extracts a preamble from the sound signal on the basis of a synchronous signal corresponding to a data candidate recognized as normal data, extracts data from the sound signal in response to the predetermined preamble size and the predetermined data size, and detects the product information through a combination of the extracted data.

5. The diagnostic system according to claim 2, wherein the diagnostic server further includes:

a signal converter that performs inverse conversion of the sound signal;

a diagnostic device that analyzes the product information using a diagnostic program and diagnostic data, and diagnoses a faulty operation of the home appliance on the basis of the analyzed result; and a main controller that outputs a diagnosis result of the diagnostic device, and transmits the diagnosis result to an external part.

6. The diagnostic system according to claim 2, wherein the signal detector, when detecting the post-preamble, controls the clock generator to generate the plurality of synchronous signals in response to the predetermined preamble size at a specific time at which the post preamble is ended.

7. The diagnostic system according to claim 1, wherein the diagnostic server extracts a preamble after performing inverse conversion of the sound signal, combines a plurality of data extracted on the basis of the preamble in consideration of the preamble size and the data size, and thus detects the product information.

8. The diagnostic system according to claim 1, wherein an interframe space follows the data and a preamble for a subsequent data follows the interframe space.

9. A diagnostic method for use in a diagnostic system of a home appliance, the diagnostic method comprising:

receiving a sound signal generated from the home appliance;

detecting a post-preamble estimated as a preamble from the sound signal, and generating a plurality of synchronous signals at intervals of a unit time in response to the detected post-preamble;

detecting product information contained in the sound signal by extracting a data candidate for each synchronous signal in response to the plurality of synchronous signals and checking an error of the data candidate; and diagnosing a status of the home appliance by analyzing the product information wherein the generating of the synchronous signals includes:

generating a plurality of synchronous signals at intervals of a predetermined unit time when detecting a post-preamble of a first time in association with the sound; and generating a plurality of synchronous signals at intervals of a predetermined unit time when detecting a post-preamble of a second time.

10. The diagnostic method according to claim 9, wherein the detecting of the product information includes:

upon receiving an error check result of a plurality of data candidates extracted in response to the plurality of synchronous signals, discarding an erroneous data candidate, and determining a data candidate recognized as a normal data candidate to be data needed for configuring the product information.

11. The diagnostic method according to claim 10, wherein the detecting of the product information includes:

extracting a preamble of the sound signal on the basis of a synchronous signal for extracting the data candidate recognized as the normal data candidate, and detecting the product information from the sound signal in response to a predetermined preamble size and a predetermined data size.

12. The diagnostic method according to claim 9, wherein the plurality of synchronous signals, after the post-preamble is detected, are generated at a specific position at which the detected post-preamble is ended.

13. The diagnostic method according to claim 9, wherein the detecting of the product information includes:

detecting a plurality of data candidates in association with a plurality of synchronous signals of the first time, detecting each of a plurality of data candidates in association with a plurality of synchronous signals of the second time, extracting each of normal data related to the first time and normal data related to the second time, and detecting the product information.

14. A diagnostic method for use in a diagnostic system of a home appliance, the diagnostic method comprising:

receiving a sound signal generated from the home appliance;

detecting a post-preamble estimated as a preamble from the sound signal, and generating a plurality of synchronous signals at intervals of a unit time in response to the detected post-preamble;

detecting product information contained in the sound signal by extracting a data candidate for each synchronous signal in response to the plurality of synchronous signals and checking an error of the data candidate; and diagnosing a status of the home appliance by analyzing the product info nation, wherein the plurality of synchronous signals, after the post-preamble is detected, are generated at a specific position at which the detected post-preamble is ended.

* * * * *